US005860524A

United States Patent [19]

Weder

[11] Patent Number: 5,860,524

[45] **Date of Patent: *Jan. 19, 1999**

[54] SHIPPING DEVICE WITH BONDABLE CUSHION LAYER

[75] Inventor: Donald E. Weder, Highland, Ill.

[73] Assignee: Southpac Trust International, Inc.

[ * ] Notice: The term of this patent shall not extend beyond the expiration date of Pat. No. 5,836,448.

[21] Appl. No.: 933,451

[22] Filed: Sep. 18, 1997

Related U.S. Application Data

[63] Continuation-in-part of Ser. No. 796,489, Feb. 5, 1997.

[51] Int. Cl.[6] ..... B65D 85/50

[52] U.S. Cl. ..... 206/423; 206/460; 206/523; 53/475

[58] Field of Search ..... 206/423, 813, 206/523, 460, 499; 53/475, 473, 443, 447, 448, 157, 445

[56] References Cited

U.S. PATENT DOCUMENTS

| | | |
|---|---|---|
| 1,064,813 | 6/1913 | Bloomberg . |
| 2,165,539 | 7/1939 | Dahlgren . |
| 2,373,634 | 4/1945 | Wagner . |
| 2,578,583 | 12/1951 | O'Brien . |
| 2,664,670 | 1/1954 | Mulford . |
| 2,707,352 | 5/1955 | Fischer . |
| 2,721,022 | 10/1955 | Billerbeck . |
| 2,744,624 | 5/1956 | Hoogstoel et al. . |
| 2,871,080 | 1/1959 | Shelly . |
| 2,887,220 | 5/1959 | Hankus . |
| 3,113,673 | 12/1963 | Stein . |
| 3,322,323 | 5/1967 | Green et al. . |
| 3,374,884 | 3/1968 | Chinkes . |
| 3,389,784 | 6/1968 | Hendricks et al. . |
| 3,466,214 | 9/1969 | Polk et al. . |
| 3,488,022 | 1/1970 | Vittori . |
| 3,708,946 | 1/1973 | Cahill . |
| 3,725,188 | 4/1973 | Kalt . |
| 3,734,280 | 5/1973 | Amneus et al. . |
| 3,754,642 | 8/1973 | Stidolph . |
| 3,883,990 | 5/1975 | Stidolph . |
| 3,924,354 | 12/1975 | Gregoire . |
| 4,053,049 | 10/1977 | Beauvais . |
| 4,170,301 | 10/1979 | Jones et al. . |
| 4,396,120 | 8/1983 | Morita . |
| 4,470,508 | 9/1984 | Yen . |
| 5,065,922 | 11/1991 | Harris . |
| 5,092,465 | 3/1992 | Weder et al. . |
| 5,111,638 | 5/1992 | Weder . |
| 5,148,918 | 9/1992 | Weder et al. . |
| 5,195,637 | 3/1993 | Weder . |
| 5,226,557 | 7/1993 | Nelson . |
| 5,240,109 | 8/1993 | Weder et al. . |
| 5,255,784 | 10/1993 | Weder et al. . |
| 5,311,992 | 5/1994 | Weder et al. . |
| 5,322,181 | 6/1994 | Nelson . |
| 5,407,072 | 4/1995 | Weder et al. . |
| 5,411,137 | 5/1995 | Weder et al. . |
| 5,522,205 | 6/1996 | Weder . |
| 5,564,567 | 10/1996 | Weder . |
| 5,584,392 | 12/1996 | Weder et al. . |

FOREIGN PATENT DOCUMENTS

| | | |
|---|---|---|
| 192843 | 11/1957 | Austria . |
| 686577 | 12/1995 | European Pat. Off. . |
| 2221936 | 10/1974 | France . |
| 2735225 | 4/1978 | Germany . |
| 61058 | of 1989 | Japan . |
| 4352664 | 12/1992 | Japan . |
| 26878 | 11/1913 | United Kingdom . |

OTHER PUBLICATIONS

"The Museum Putty" brochure Is Your Home a Museum of Collectibles?, 3 pages, Aug. 2, 1993.

Oasis Grower Products; Smithers–Oasis; Kent, OH; 1991.

*Primary Examiner*—Paul T. Sewell
*Assistant Examiner*—Nhan T. Lam
*Attorney, Agent, or Firm*—Dunlap, Codding & Rogers, P.C.

[57] ABSTRACT

A method and apparatus for preparing an item or plurality of items for shipment. Disposing one or a plurality of items on a rigid surface having a layer of deformable cushioning material with a bonding material thereon wherein the items are connectingly bonded to the foam layer which is deformed in response to the items. The items may be items of china, floral containers, and flower pots, or other similar items.

22 Claims, 2 Drawing Sheets

SHIPPING DEVICE WITH BONDABLE CUSHION LAYER

CROSS REFERENCE TO RELATED APPLICATIONS

The present application is a continuation-in-part of U.S. Ser. No. 08/796,489, filed Feb. 5, 1997.

STATEMENT REGARDING FEDERALLY SPONSORED RESEARCH OR DEVELOPMENT

Not applicable

BACKGROUND

The present invention is related to methods for transporting various items such as floral containers and china, wherein the items are bondingly connected to a surface having a bonding layer thereon for minimizing movement and disturbance of the items during transportation.

DESCRIPTION OF THE PREFERRED EMBODIMENTS

Figure 1:
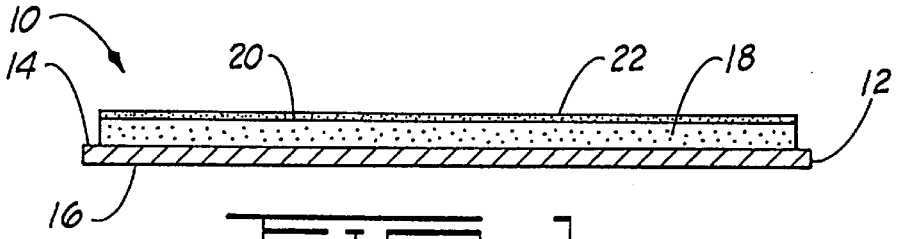
FIG. 1 is a side view of a shipping device constructed for use in accordance with the present invention.

Shown in FIG. 1 and designated by the general reference numeral 10 is a shipping device constructed in accordance with the present invention. The shipping device 10 comprises a rigid or semi-rigid support surface 12 which has an upper surface 14 and a lower surface 16. A layer of cushioning material 18 is connected to the upper surface 14 of the support surface 12. In a preferred embodiment the cushioning material 18 is a foam layer 18. In another preferred version, the cushioning material comprises a sheet of bubble wrap attached to the support surface 12. Bubble wrap is commercially available in many sizes and is well known to a person of ordinary skill in the art. The cushioning material 18 has an upper surface 20. In a preferred version of the invention a layer of connecting bonding material 22 is disposed upon the upper surface 20 of the cushioning material 18. When the cushioning material 18 is a foam layer, the bonding material 22 is generally not a completely discrete layer but at least partially infiltrates into an upper portion of the foam layer 18, and may extend well into the foam layer 18. The items contained within the shipping assembly are rendered substantially immobile upon the shipping device 12, and may be further cushioned, protected, or immobilized by packing material (not shown) disposed within the interstices of the shipping assembly 28. Such packing materials are well known to those of ordinary skill in the art. In an alternate embodiment the bonding material may be dispersed throughout the cells of the foam comprising the foam layer 18 so there is not a discrete layer of bonding material which comprises the connecting bonding material 22. Included in this alternative embodiment are versions of foam which have inherently adhesive properties.

The foam layer 18 may be disposed upon only a portion of the upper surface of the support surface 12, or upon the entire support surface 12.

The support surface 12 may be any shape which functions in accordance with the present invention. The support surface 12, may, for example, be square, rectangular, circular or any other geometric shape which enhances the function of the sheet for the purpose disclosed herein. The support surface 12 may be cardboard, wood, metal, plastic, resin, or any rigid or semi-rigid material. The support surface 12 may be the bed of a truck. The support surface 12 may be a laminar combination of any of the above materials. Any thickness of the support surface 12 may be utilized in accordance with the present invention as long as the support surface 12 functions to support the objects disposed thereupon.

The object supported by the support device 10 may be china, a vase, a flower pot or a growing tray containing a floral grouping. As used herein, the term china includes everyday dishes, cups, plates, bowls, vases, trays, pitchers and other similar household table items and may be made from plastic, ceramic, glass, metal, porcelain or other materials used to manufacture such items. Vase or flower pot or growing tray refers to any type of container used for holding the floral grouping or single floral cuttings. In a preferred embodiment only a single vase or flower pot with a floral grouping therein is disposed on the support device 10, the bonding material 22 comprising the only substantial means of maintaining the vase or flower pot in an upright orientation. "Floral grouping" as used herein means cut fresh flowers, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

As used herein the term "foam" means a three-dimensional porous material having a reticulated configuration in cross section and which is pliable and conformable. Examples of foams are open cell polyurethane foams, PVA foam, and Hypol foam. Preferably the foam has a relatively consistent density and thickness. Preferably the foam layer is from about ⅛ to ¼ inches thick. An optimal thickness is 3/16 inches. Foam materials which may be used in the present invention are commercially available from various sources, such as that sold under the designation SIFZ Felted foam #2 obtainable from Foamex, Inc.; Crest Felted S-90Z, firmness 2 polyurethane foam distributed by Great Western; a microcellular hydrophilic polyurethane manufactured by Time Release Science and distributed by Truly Magic Products Inc.; PVA foam E-1 or E-2 distributed by Rippey Corp.; Hypol foam (2002, 2000, or 3000) produced by Hampshire Chemical Inc.; Acquell and hydrophilic foam manufactured by Foamex Foam Inc., #T70 foam produced by Crown Product Corp., and Bio-Foam available from Smithers Bio-Medical Systems of Kent, Ohio. Deformable styrofoams may also be used.

An example of a bonding material which may be applied to the upper surface 20 of the cushioning material 18 is Adhesive #9211 available from Dyna-Tech Adhesives of Grafton, WV. As will be readily appreciated by one of ordinary skill in the art, any number of adhesive or cohesive bonding materials are commercially available which would function in accordance with the present invention, as long as they adhere to the cushioning material 18 and to the object disposed thereon.

The term "bonding material or bonding means" when used herein means an adhesive, frequently a pressure sensitive adhesive, or a cohesive or any other bonding material which functions as a bonding material in accordance with the invention described herein. When the bonding material is a cohesive, a similar cohesive material must be present on a surface of the object which will be disposed on the bonding surface of the shipping device. Preferably, when the bonding material is an adhesive, the cohesive forces between adhesive molecules within the foam are stronger than the adhesive forces between the adhesive and the item placed thereon so that when the item is removed from the foam a minimum of adhesive is left on the item.

Figure 2:
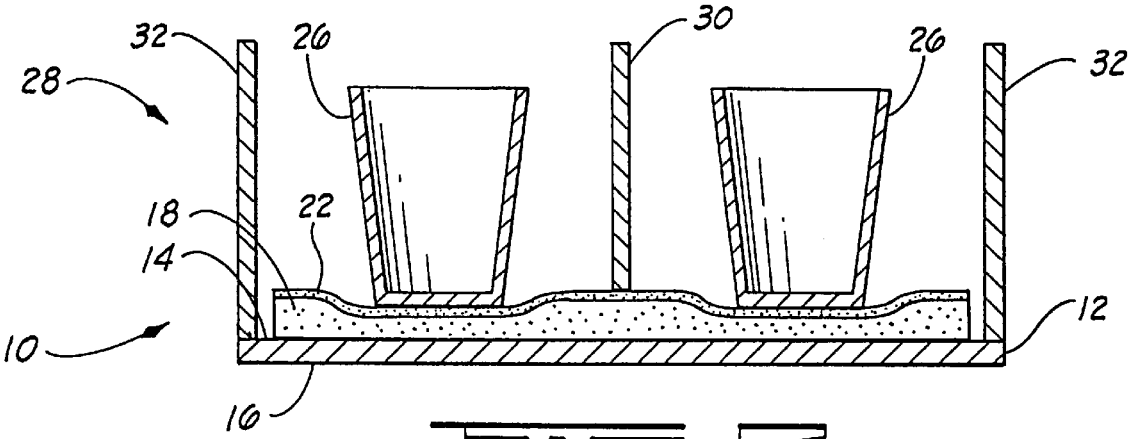
FIG. 2 is a side view of a shipping assembly constructed in accordance with the present invention.

Shown in FIG. 2 is a plurality of containers 26 bondingly connected to the shipping device 10 via the connecting bonding material 22 disposed on the cushioning material 18 which is shown as a foam layer. The containers 26 and the shipping device 10 together constitute a shipping assembly 28 which may be used to ship the containers 26 to a predetermined location. Each container 26 is anchored or secured to the shipping device 10 via the bonding material 22 and is cushioned and stabilized by the foam layer 18. When the container 26 is placed upon the shipping device 10, the container 26 deforms a portion of the foam layer 18 upon which the container 26 rests, as indicated in FIG. 2. The foam layer 18 (or any other cushioning material contemplated herein) thereby at least partially conforms to the shape of the container 26 for enhancing the bonding connection between the foam layer 18 and the container 26. Preferably the cushioning layer 18 (in this case, the foam layer 18), returns to its original shape when the container 26 is removed from the foam layer 18 after shipping. It will be appreciated by one of ordinary skill in the art that the container shape displayed herein is but one of the great variety of shapes of objects, items or containers which may be used in accordance with the present invention. The bonding material 22 may be disposed on all of or only a portion of the upper surface of the foam layer 18. The bonding material 22 may have a release layer disposed thereon for maintaining the bonding properties of the bonding material and is removed prior to use of the device 10.

Also shown in the shipping assembly 28 in FIG. 2 is an optional partition 30 (also referred to as an insert) which is disposed between or over the objects disposed upon the shipping device. Also shown in the shipping assembly 28 in FIG. 2 are optional sidewalls 32 which extend vertically from the support surface 12 surrounding the foam layer 18 and which at least partially enclose a space within which the containers reside. The shipping assembly 26 may further comprise a lid (not shown). Although the foam layer 18 is indicated in FIGS. 1–2 as comprising a continuous layer, the foam layer 18 may instead be disposed upon the support surface 12 in any functional geometric form or pattern including spots, designs, strips, or squares.

The term "floral grouping" when used herein generally means a plant having a bloom portion and a stem portion. Further, the floral grouping 34 may comprise a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule" and may include a plant having only foliage and no blooms.

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

Figure 3:
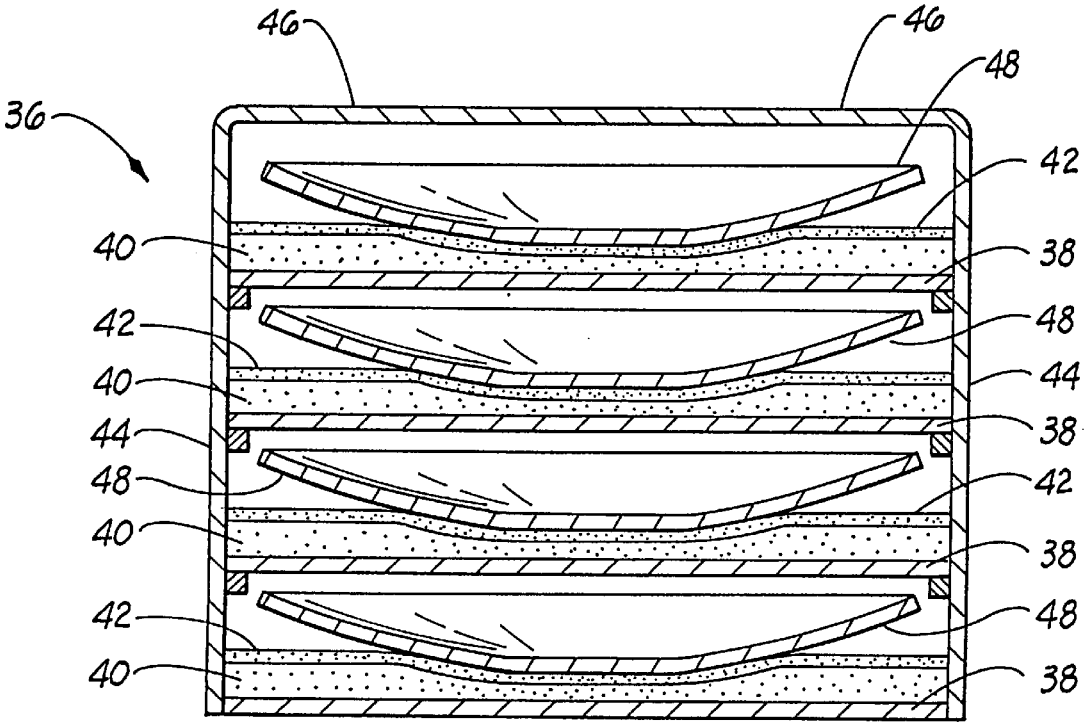
FIG. 3 is a side view of another shipping assembly constructed in accordance with the present invention.

An alternative version of the present invention, shown in FIG. 3, is a shipping assembly designated by the general reference numeral 36. The shipping assembly 36 has a plurality of interior support surfaces 38, each having a cushioning material 40 exactly the same as described above and each having a connecting bonding material 42 disposed thereon. The assembly 36 may comprise a plurality of side walls 44 and upper flaps 46 which are shown in FIG. 3 in a closed position but when lifted in an outward direction can be opened into an open position. Each support surface 38 holds at least one item 48, as described earlier; the item 48 disposed on the cushioning material 40 and connected thereto via the bonding material 42, exactly as described above for the shipping assembly 28. The cushioning material 40 may be a foam layer or bubble layer as noted elsewhere herein.

Figure 4:
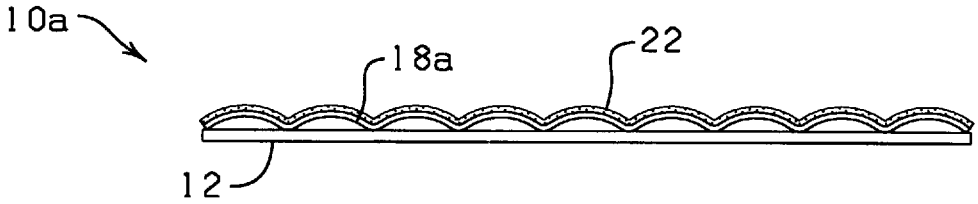
FIG. 4 is a side view of another version of the present invention.
Figure 5:
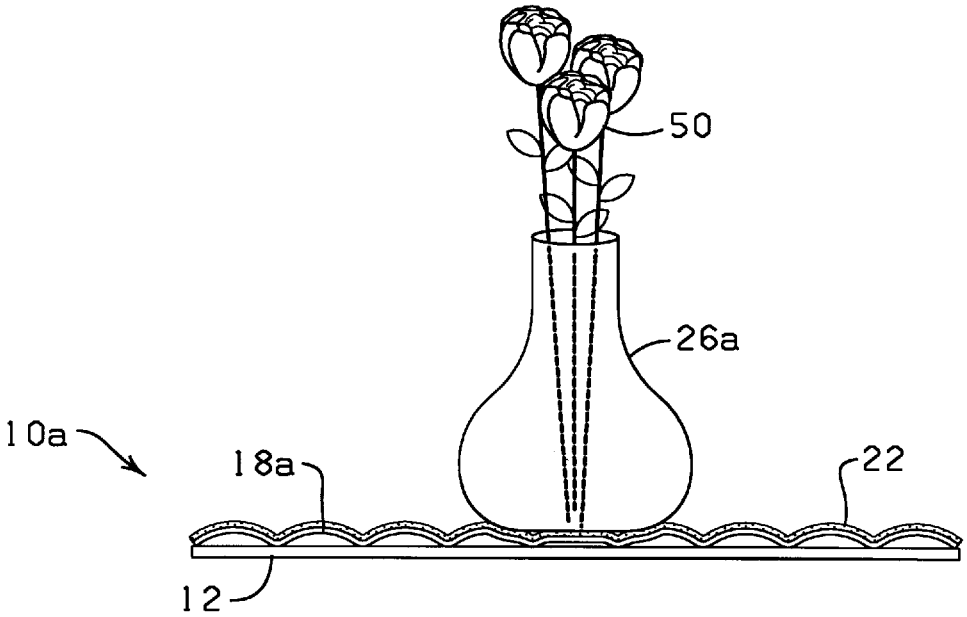
FIG. 5, is a side view of the assembly of FIG. 4 having a floral container disposed thereon.

Shown in FIG. 4 is an alternate preferred version of the invention. Designated by the general reference numeral **10*a* is a shipping device exactly the same as that shown in FIG. 1 except the cushioning material 18*a* is a bubble wrap material. The bubble wrap 18*a* is attached to the support surface 12, as above, and has a bonding material 22 disposed thereon. In use, as shown in FIG. 5, a floral container such as a vase or flower pot 26*a*, preferably having a floral grouping 50 disposed therein, is disposed upon the bubble wrap 18*a*, and is connected thereto via the bonding material 22. The vase or flower pot 26*a* deforms a portion of the bubble wrap 18*a* as shown in FIG. 5, thereby eliciting a cushioning effect from the bubble wrap 18*a*. The vase or flower pot 26*a* is thereby anchored or secured to the support surface 12, in a generally upright orientation for shipment or transport. The cushioning material may comprise any deformable material known to persons of ordinary skill in the floral arts which functions in accordance with the present invention. The bonding material may be disposed on all, or only a portion, of the upper surface of the bubble wrap 18*a***.

When constructing the shipping devices embodied herein, it is preferable that when the support surface 12 is a cardboard or other material which may be warped by wetness, the adhesive material which is used to connect the lower surface of the cushioning material to the support surface is placed first on the lower surface of the cushioning material (rather than to the support surface) before the cushioning material is applied to the support surface.

Changes may be made in the construction and the operation of the various components, elements and assemblies described herein or in the steps of the methods described therein without departing from the spirit and scope of the invention as defined in the following claims.

What is claimed is:

1. A method of preparing an item for shipment, comprising:

providing a shipping device comprising a support surface at least a portion of which has a layer of deformable bubble wrap material disposed thereupon and connected thereto, the deformable bubble wrap material having an upper bonding surface comprising a connecting bonding material; and securing at least one item to the shipping device by placing the item upon the deformable bubble wrap material of the shipping device and bondingly connecting the item to the deformable bubble wrap material via the connecting bonding material wherein a portion of the deformable bubble wrap material adjacent the item is deformed in response to pressure exerted on the deformable bubble wrap material by the item wherein the item is cushioned and secured for shipment.

2. The method of claim 1 wherein in the step of providing the shipping device the bonding material is an adhesive.

3. The method of claim 1 wherein in the step of placing the item, the item comprises a connecting bonding material disposed upon a portion thereof for cooperating with the connecting bonding material of the deformable bubble wrap material to bondingly connect the item to the deformable bubble wrap material.

4. The method of claim 3 wherein in the step of providing the shipping device and placing the item, the connecting bonding material of the deformable bubble wrap material and the connecting bonding material of the item are cohesive materials.

5. The method of claim 1 wherein in the step of providing the shipping device, the shipping device further comprises a plurality of side walls attached to the support surface and surrounding the deformable bubble wrap material.

6. The method of claim 1 comprising the additional step of disposing a partition adjacent the item bondingly connected to the deformable bubble wrap material of the shipping device.

7. The method of claim 1 wherein in the step of placing the item, the item is an item of china.

8. The method of claim 1 wherein on the step of placing the item, the item is a floral container.

9. The method of claim 8 wherein the floral container contains a floral grouping disposed therein.

10. The method of claim 1 further comprising the step of transporting the shipping device and the item secured thereto to a predetermined destination.

11. A method of preparing a floral container and floral grouping for shipment, comprising:

providing a shipping device comprising a support surface at least a portion of which has a layer of deformable bubble wrap material disposed thereupon and connected thereto, the deformable bubble wrap material having an upper bonding surface comprising a connecting bonding material; and securing at least one floral container having a floral grouping contained therein to the shipping device by placing the floral container upon the deformable bubble wrap material of the shipping device and bondingly connecting the floral container to the deformable bubble wrap material via the connecting bonding material wherein a portion of the deformable bubble wrap material adjacent the floral container is deformed in response to pressure exerted on the deformable bubble wrap material by the floral container wherein the floral container is cushioned and secured for shipment.

12. The method of claim 11 wherein in the step of providing the shipping device the bonding material is an adhesive.

13. The method of claim 11 wherein in the step of placing the floral container, the floral container comprises a connecting bonding material disposed upon a portion thereof for cooperating with the connecting bonding material of the deformable bubble wrap material to bondingly connect the floral container to the deformable bubble wrap material.

14. The method of claim 13 wherein in the step of providing the shipping device and placing the floral container, the connecting bonding material of the deformable bubble wrap material and the connecting bonding material of the floral container are cohesive materials.

15. The method of claim 11 wherein in the step of providing the shipping device, the shipping device further comprises a plurality of side walls attached to the rigid support surface and surrounding the deformable bubble wrap material.

16. The method of claim 11 comprising the additional step of disposing a partition adjacent the floral container bondingly connected to the deformable bubble wrap material of the shipping device.

17. The method of claim 11 further comprising the step of transporting the shipping device and the floral container secured thereto to a predetermined destination.

18. A shipping assembly, comprising:

a shipping device comprising a support surface at least a portion of which has a layer of deformable bubble wrap material disposed thereupon and connected thereto, the layer of deformable bubble wrap material having an upper bonding surface comprising a connecting bonding material; and at least one floral container having a floral grouping contained therein placed upon the deformable bubble wrap material of the shipping device and bondingly connected to the deformable bubble wrap material via the connecting bonding material in a substantially upright orientation wherein a portion of the deformable bubble wrap material adjacent the floral container is deformed in response to pressure exerted on the deformable bubble wrap material by the floral container wherein the floral container is cushioned and secured to the device for shipment.

19. The shipping device of claim 18 wherein the connecting bonding material is an adhesive.

20. The shipping assembly of claim 18 wherein the floral container comprises a connecting bonding material disposed thereon for cooperating with the connecting bonding material of the deformable bubble wrap material to bondingly connect the floral container to the deformable bubble wrap material.

21. The shipping assembly of claim 20 wherein the connecting bonding material of the deformable bubble wrap material and the connecting bonding material of the floral container are cohesive bonding materials.

22. The shipping assembly of claim 18 wherein the rigid support surface is constructed from the group consisting of cardboard, wood, metal, glass, plastic, thermoplastics, fiberglass, and resins.

* * * * *

UNITED STATES PATENT AND TRADEMARK OFFICE

CERTIFICATE OF CORRECTION

PATENT NO. : 5,860,524
DATED : January 19, 1999
INVENTOR(S) : Donald E. Weder

It is certified that error appears in the above-identified patent and that said Letters Patent is hereby corrected as shown below:

Column 1,
Line 45, after "material" and before "comprises" insert -- 18 --;
Line 57, after "assembly" and before "are" insert -- 28 --;
Line 58, delete "shipping device" and substitute -- support surface -- therefor;
Line 60, after "of" and before "shipping" delete "the" and substitute -- a -- therefor;
Line 63, after "material" and before "may" insert -- 22 --;
Line 65, after "material" and before "which" insert -- 22 --;

Column 2,
Line 8, delete "sheet" and substitute -- support surface 12 -- therefor;
Line 47, delete "inches" and substitute -- inch -- therefor;
Line 48, delete "inches." and substitute -- inch. -- therefor;

Column 3,
Line 52, delete "26" and substitute -- 28 -- therefor;
Line 60, delete "34";

Column 4,
Line 26, after "The" and before "assembly" insert -- shipping --;
Line 57, after "devices" and before "embodied" insert -- 10 or **10*a*** --;
Line 61, after "material" and before "to" insert -- 18 --;
Line 62, after "surface" and before "is" insert -- 12 --;
Line 63, after "material" and before "(rather" insert -- 18 --; and delete "surface)" and substitute therefor -- surface 12) -- therefor;
Line 64, after "material" and before "is" insert -- 18 --;
Line 64, delete "surface." and substitute -- surface 12. -- therefor;

UNITED STATES PATENT AND TRADEMARK OFFICE

CERTIFICATE OF CORRECTION

PATENT NO. : 5,860,524
DATED : January 19, 1999
INVENTOR(S) : Donald E. Weder

It is certified that error appears in the above-identified patent and that said Letters Patent is hereby corrected as shown below:

Column 6,
Line 21, delete "rigid"; and
Line 61, delete "rigid".

Signed and Sealed this

Twentieth Day of November, 2001

*Attest:*

Nicholas P. Godici

NICHOLAS P. GODICI
*Acting Director of the United States Patent and Trademark Office*

*Attesting Officer*